US006623246B2

(12) United States Patent
Hwang et al.

(10) Patent No.: US 6,623,246 B2
(45) Date of Patent: Sep. 23, 2003

(54) APPARATUS AND METHOD FOR CONTROLLING OPERATION OF LINEAR MOTOR COMPRESSOR

(75) Inventors: Yin Young Hwang, Anyang (KR); Joon Hyung Park, Seoul (KR); Jin Koo Park, Gwangmyeong (KR); Sang Ho Seo, Gwangmyeong (KR); Ui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/040,639

(22) Filed: Jan. 9, 2002

(65) Prior Publication Data

US 2002/0150477 A1 Oct. 17, 2002

(30) Foreign Application Priority Data

| | | |
|---|---|---|
| Apr. 13, 2001 | (KR) | 2001-0019903 |
| Apr. 13, 2001 | (KR) | 2001-0019904 |
| Apr. 13, 2001 | (KR) | 2001-0019905 |
| Apr. 13, 2001 | (KR) | 2001-0019910 |
| Apr. 24, 2001 | (KR) | 2001-0022063 |
| Apr. 24, 2001 | (KR) | 2001-0022073 |
| Apr. 24, 2001 | (KR) | 2001-0022075 |

(51) Int. Cl.[7] ..... F04B 49/06

(52) U.S. Cl. ..... 417/44.1; 417/53; 417/44.11; 417/18; 417/45; 417/212; 417/417

(58) Field of Search ..... 417/53, 44.1, 44.11, 417/45, 18, 212, 417

(56) References Cited

U.S. PATENT DOCUMENTS

| | | | | |
|---|---|---|---|---|
| 4,783,807 A | * | 11/1988 | Marley | 704/235 |
| 5,032,772 A | * | 7/1991 | Gully et al. | 318/135 |
| 5,200,644 A | * | 4/1993 | Kobayashi et al. | 307/66 |
| 5,209,075 A | * | 5/1993 | Kim | 62/126 |
| 5,615,097 A | * | 3/1997 | Cross | 363/84 |
| 5,658,132 A | * | 8/1997 | Akazawa et al. | 417/415 |
| 5,771,704 A | * | 6/1998 | Nakajima et al. | 62/228.4 |
| 5,947,693 A | * | 9/1999 | Yang | 417/45 |
| 5,980,211 A | * | 11/1999 | Tojo et al. | 417/45 |
| 6,084,320 A | * | 7/2000 | Morita et al. | 310/12 |
| 6,153,951 A | * | 11/2000 | Morita et al. | 310/12 |
| 6,176,683 B1 | * | 1/2001 | Yang | 417/44.1 |
| 6,231,310 B1 | * | 5/2001 | Tojo et al. | 417/44.1 |
| 6,289,680 B1 | * | 9/2001 | Oh et al. | 62/6 |
| 6,520,746 B2 | * | 2/2003 | Yoo et al. | 417/44.11 |
| 6,524,075 B2 | * | 2/2003 | Hwang et al. | 417/44.11 |
| 6,527,519 B2 | * | 3/2003 | Hwang et al. | 417/44.11 |
| 2002/0064461 A1 | * | 5/2002 | Yoo et al. | 417/44.1 |
| 2002/0064462 A1 | * | 5/2002 | Park et al. | 417/44.1 |
| 2002/0157408 A1 | * | 10/2002 | Egawa et al. | 62/228.1 |

* cited by examiner

*Primary Examiner*—Charles G. Freay
*Assistant Examiner*—William H. Rodriguez
(74) *Attorney, Agent, or Firm*—Birch, Stewart, Kolasch & Birch, LLP

(57) ABSTRACT

An apparatus and a method for controlling operation of a linear motor compressor, by which a linear motor compressor can operate always in an optimum condition by coping with the load variation due to changes in a refrigerator and the circumstances. In more detail, a current peak value at TDC=0 is detected by comparing a current applied to the linear motor compressor with a formerly detected current, and accordingly the linear motor compressor is operated by a switching control signal generated according to a duty-ratio corresponding to the current peak value.

23 Claims, 4 Drawing Sheets

APPARATUS AND METHOD FOR CONTROLLING OPERATION OF LINEAR MOTOR COMPRESSOR

BACKGROUND OF THE INVENTION

1. Field of the Invention

The present invention relates to a linear motor compressor, and in particular to an apparatus and a method for controlling operation of a linear motor compressor which is capable of operating a linear motor compressor in an optimum condition.

2. Description of the Prior Art

Generally, by eliminating the use of a crankshaft for converting a rotary motion into a linear motion, a linear motor compressor has a low frictional loss, and accordingly the linear motor compressor is superior to a general compressor in the compressing efficiency aspect.

When the linear motor compressor is used for a refrigerator or an air conditioner, a cooling capacity of the refrigerator or the air conditioner can be controlled by varying a compression ratio of the linear motor compressor by varying a stroke voltage applied to the linear motor compressor. The linear motor compressor will be described with reference to accompanying FIG. 1.

FIG. 1 is a schematic block diagram illustrating the construction of an apparatus for controlling the operation of a linear motor compressor in accordance with the prior art.

As depicted in FIG. 1, the apparatus for controlling the operation of a linear motor compressor in accordance with the prior art applies a stroke voltage to an internal motor (not shown) of a linear motor compressor 13 for varying an internal stroke supplied according to a stroke reference value set by a user, thereby adjusting a cooling capacity by moving an internal piston (not shown) back and forth. A voltage detecting unit 14 detects a voltage generated in the linear motor compressor 13 according to the variation of the stroke, and a current detecting unit 12 detects a current generated in the linear motor compressor 13 according to the variation of the stroke. A microcomputer 15 calculates the stroke by using the voltage detected by the voltage detecting unit 14 and the current detected from the current detecting unit 12, comparing the calculated stroke with the stroke reference value and outputting a switching control signal according to the comparison result. And a power supply unit 11 supplies the stroke voltage to the linear motor compressor 13 by on-off controlling the supplying of AC power to the linear motor compressor 13 using a triac Tr1 controlled by the switching control signal from the micro-computer 15. Hereinafter, the operation of the apparatus for controlling the operation of the linear motor compressor will be described.

First, the stroke of the linear motor compressor 13 is varied in accordance with the voltage supplied to the motor according to the stroke reference value, and thereby adjusts the cooling capacity by moving the piston back and forth according to the varied stroke. Herein, the term "stroke" means a distance over which the piston inside the linear motor compressor 13 moves while performing a reciprocating motion (moving back and forth).

When the triac Tr1 of the power supply unit 11 has a longer turn-on duration in accordance with the switching control signal outputted from the microcomputer 15, at this time the AC turn-on power is supplied to the linear motor compressor 13, and the linear motor compressor 31 operates.

Herein, the voltage detecting unit 14 and the current detecting unit 12 respectively detect a voltage and a current applied to the linear motor compressor 13 and respectively output the detected voltage and current to the microcomputer 15.

The microcomputer 15 calculates the stroke by using the voltage and the current detected from the voltage detecting unit 14 and the current detecting unit 12, compares the calculated stroke with the stroke reference value and outputs the switching control signal according to the comparison result. In more detail, when the calculated stroke value is smaller than the stroke reference value, the microcomputer 15 increases the stroke voltage supplied to the linear motor compressor 13 by outputting a switching control signal for lengthening the turn-on cycle of the triac Tr1 in the power supply unit 11.

On the contrary, when the calculated stroke value is larger than the stroke reference value, the microcomputer 15 decreases the stroke voltage supplied to the linear motor compressor 13 by outputting a switching control signal for shortening the turn-on cycle of the power supply unit 11.

However, because the linear motor compressor control apparatus according to the prior art controls the operation of the linear motor compressor by comparing the calculated stroke with the stroke reference value and outputting a switching control signal to the power supply unit according to the comparison result, accordingly the operation of the linear motor compressor can not be controlled accurately. In more detail, since the linear motor compressor control apparatus according to the prior art has a severe non-linearity in its mechanical motion functions, the operation of the linear motor compressor can not be performed precisely and accurately by a linear control method without considering the non-linearity.

In addition, in the linear motor compressor control apparatus according to the prior art, when the linear motor compressor is operated continually in accordance with an initial detected switching control signal, a position of the piston may deviate from TDC (Top Dead Center)=0 due to a load variation according to changes in a refrigerator and other circumstances.

SUMMARY OF THE INVENTION

Accordingly, it is an object of the present invention to provide an apparatus and a method for controlling the operation of a linear motor compressor which is capable of operating a linear motor compressor precisely and accurately by detecting a peak value of a current waveform generated in a linear motor compressor, recognizing the peak value of the current waveform as a point TDC=0 and operating the linear motor compressor according to a duty-ratio corresponding to maintaining the point TDC =0.

It is another object of the present invention to provide an apparatus and a method for controlling the operation of a linear motor compressor which is capable of operating a refrigerator efficiently by detecting a current peak value in an optimum operation condition as TDC=0 when the load varies due to changes in a refrigerator and the operating circumstances, recognizing the detected peak value of the current waveform as a position in TDC=0 and operating a linear motor compressor according to a duty-ratio corresponding to maintaining the recognized point TDC=0.

It is yet another object of the present invention to provide an apparatus and a method for controlling the operation of a linear motor compressor which is capable of operating a refrigerator efficiently by periodically detecting a current peak value as TDC=0 when a load change according to changes in a refrigerator and the operating circumstances, recognizing the detected peak value of the current waveform as a position TDC=0 and operating the linear motor compressor according to a duty-ratio corresponding to maintaining the recognized point TDC=0.

It is still another object of the present invention to provide an apparatus and a method for controlling operation of a linear motor compressor which is capable of operating a linear motor compressor in an optimum operation condition by detecting load variation due to changes in a refrigerator and the circumstances with a quantity of power consumption, comparing the quantity of power consumption with a maximum power quantity and a minimum power quantity and detecting a current peak value in TDC= according to the comparison result.

It is yet still another object of the present invention to provide an apparatus and a method for controlling operation of a linear motor compressor which is capable of operating a linear motor compressor in an optimum condition by checking load variation of a refrigerator with current variation by using currents generated in a linear motor compressor.

In order to achieve the above-mentioned objects, an apparatus for controlling operation of a linear motor compressor in accordance with the present invention includes a current detecting unit detecting a current generated in a linear motor compressor, a current peak value detecting unit detecting a current peak value by comparing the detected current with a formerly detected current, a microcomputer recognizing the current peak value as a point of TDC=0 and outputting a switching control signal according to a duty-ratio corresponding to the point of TDC=0, and a power supply unit operating the linear motor compressor by controlling operation of an internal triac according to the switching control signal.

A method for controlling operation of a linear motor compressor in accordance with the present invention includes detecting an initial current peak value as TDC (Top Dead Center)=0 on the basis of currents supplied to a linear motor compressor, setting a limitation value at a point of detecting the initial current peak value, and redetecting a current peak value as TDC=0 by comparing the current value generated in the linear motor compressor with the limitation value.

A method for controlling operation of a linear motor compressor in accordance with the present invention includes detecting an initial current peak value as TDC=0 by comparing a current applied to a linear motor compressor with a formerly detected current, setting a certain time period for redetecting an optimum operation condition as TDC=0 on the basis of a time of detecting the initial current peak value, judging whether the certain time period is passed while operating the linear motor compressor with a switching control signal corresponding to the initial current peak value, and redetecting a current peak value as TDC=0 after the certain time period is passed and operating the linear motor compressor with a switching control signal corresponding to the re-detected current peak value.

A method for controlling operation of a linear motor compressor in accordance with the present invention includes detecting a current peak value as TDC=0 by comparing a current applied to a linear motor compressor with a formerly detected current, setting a maximum current value for redetecting an optimum operation condition at TDC=0 on the basis of the detected current peak value, operating the linear motor compressor with a switching control signal corresponding to the detected current peak value and at the same time comparing a first current value applied to the linear motor compressor with the set maximum current value, and detecting a current peak value at TDC=0 when the first current value is larger than the set maximum current value.

A method for controlling operation of a linear motor compressor in accordance with the present invention includes detecting an initial current peak value at TDC=0, detecting a quantity of power consumption on the basis of a current and a voltage generated in the linear motor compressor, setting a minimum power quantity and a maximum power quantity on the basis of the detected current and voltage, and operating the linear motor compressor by a switching control signal corresponding to the initial current peak value, while at the same time comparing the quantity of power consumption with the maximum power quantity and the minimum power quantity and controlling the operation of the linear motor compressor according to the comparison result.

A method for controlling operation of a linear motor compressor in accordance with the present invention includes detecting an initial current peak value as TDC=0 by comparing a current applied to a linear motor compressor with a formerly detected current, setting a redetecting time period for detecting a current peak value as TDC=0 on the basis of a detecting time point of the initial current peak value, judging whether the set redetecting time period is passed and at the same time operating the linear motor compressor with a switching control signal corresponding to the initial current peak value, and redetecting a current peak value as TDC=0 and controlling the operation of the linear motor compressor with a switching control signal corresponding to the detected current peak value.

A method for controlling operation of a linear motor compressor in accordance with the present invention includes judging whether a flag for detecting a duty-ratio of a driving current of a linear motor compressor is set, judging whether a peak value of a current waveform driving the linear motor compressor a duty-ratio corresponding to the peak value of the current waveform is not greater than a certain value, detecting a peak value of the driving current waveform and generating a switching control signal according to a duty-ratio corresponding to the detected peak value when the peak value of the current waveform and the duty-ratio are not greater than the certain value, and operating the linear motor compressor according to the switching control signal.

DETAILED DESCRIPTION OF THE PREFERRED EMBODIMENT

Hereinafter, embodiments of an apparatus and a method for controlling the operation of a linear motor compressor of a refrigerator in accordance with the present invention will be described in detail with reference to accompanying FIGS. 2~4.

Figure 1:
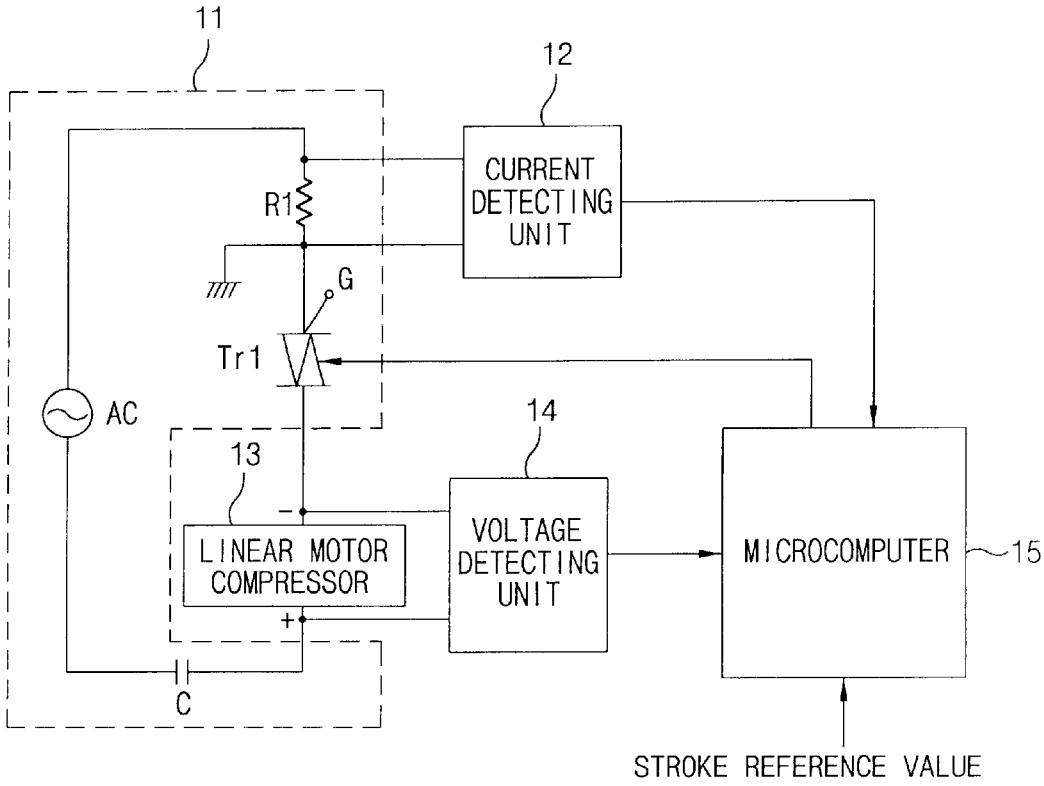
FIG.1 CONVENTIONAL ART
FIG. 1 is a schematic block diagram illustrating the construction of an apparatus for controlling the operation of a linear motor compressor in accordance with the prior art.
Figure 2:
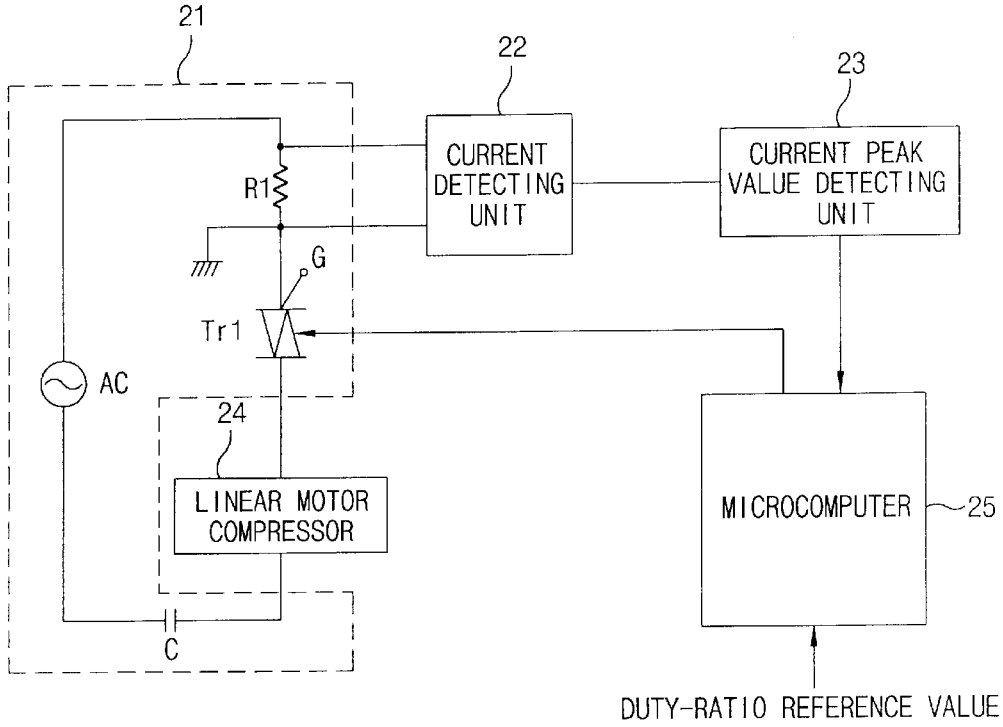
FIG. 2 is a schematic block diagram illustrating the construction of an apparatus for controlling the operation of a linear motor compressor in accordance with the present invention.

FIG. 2 is a schematic block diagram illustrating the construction of an apparatus for controlling the operation of a linear motor compressor in accordance with the present invention.

As depicted in FIG. 2, the apparatus for controlling the operation of a linear motor compressor in accordance with the present invention is applied to a linear motor compressor 24 for varying the stroke of an internal piston (not shown) of the linear motor compressor according to a duty-ratio reference value for thereby adjusting the cooling capacity. The apparatus includes a current detecting unit 22 detecting a current applied to the linear motor compressor 24, a current peak value detecting unit 23 detecting a current peak value by comparing the current detected in the current detecting unit 20 with a formerly detected current, a microcomputer 25 receiving the current peak value detecting signal outputted from the current peak value detecting unit 23 and recognizing the detected current peak value as a point of top dead center (TDC=0) and outputting a switching control signal according to a duty-ratio corresponding to the point TDC=0, and a power supply unit 21 operating the linear motor compressor by controlling the operation of an internal triac according to the switching control signal outputted from the microcomputer 25.

Herein, the apparatus and method according to the present invention detects a peak value of a current waveform generated in the linear motor compressor 24, recognizes the peak value of the detected current waveform as a point in TDC=0 and generates the witching control signal to control the operation of the linear motor compressor with a duty-ratio corresponding to the recognized point TDC=0. In more detail, the apparatus and method for controlling the operation of a linear motor compressor in accordance with the present invention can control the operation of the linear motor compressor 24 precisely and accurately by using the current peak value detecting unit 23.

Hereinafter, the operation of the apparatus for controlling the operation of the linear motor compressor in accordance with the present invention will be described in detail.

First, the stroke of the linear motor compressor 24 is varied according to the duty-ratio reference value to adjust the cooling capacity by moving the piston back and forth according to the varied stroke. Herein, the term "stroke" means a distance over which the piston inside the compressor moves while performing a reciprocating motion inside the linear motor compressor 24.

The power supply unit 21 operates the linear motor compressor 24 by controlling the on/off operation of the internal triac Tr1 according to the switching control signal outputted from the microcomputer 25. Herein, the current detecting unit 22 detects a current applied to the linear motor compressor 21 and outputs the detected current to the current peak value detecting unit 23.

The current peak value detecting unit 23 is inputted the current detected by the current detecting unit 22, compares the inputted current with a formerly detected current value and outputs a current peak value detecting signal. Herein, the formerly detected current value is stored in an internal unit (not shown) of the microcomputer 25. In more detail, the current peak value detecting unit 23 compares the present detected current value with the formerly detected current value, and in the case when the formerly detected current value is larger than the present detected current value, the current peak value detecting unit 23 recognizes the formerly detected current value as a current peak value and outputs a current peak value detecting signal according to the recognized current peak value to the microcomputer 25.

The microcomputer 25 receives the current peak value detecting signal and detects a peak value of a current waveform of the signal, recognizes the peak value of the current waveform as a point TDC=0, generates a switching control signal according to a duty-ratio corresponding to the point TDC=0 and outputs it to the power supply unit 21.

The power supply unit 21 controls the operation of the linear motor compressor 24 by controlling the operation of the triac Tr1 according to the switching control signal outputted from the microcomputer 25.

Herein, variation of the current waveform according to the increase in the duty-ratio will be described in detail with reference to accompanying FIG. 3.

Figure 3:
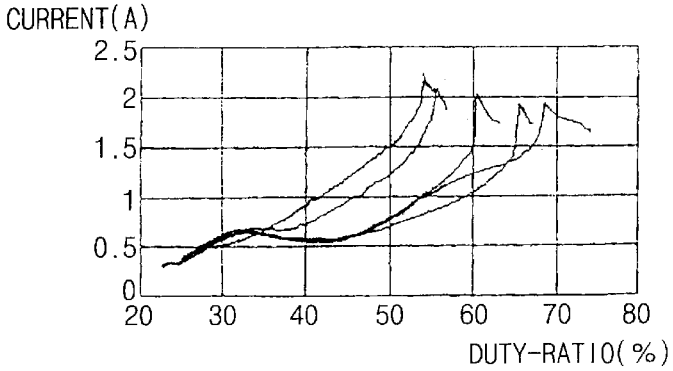
FIG. 3 is a waveform diagram illustrating the variation of a current waveform according to an increase in a duty-ratio of a switching control signal in accordance with the present invention.

FIG. 3 is a waveform diagram illustrating the variation of a current waveform according to the increase in the duty-ratio of the switching control signal in accordance with the present invention. In more detail, in a test result of the present invention, a peak value of the current waveform is generated at a point at which the piston of the linear motor compressor 24 is located at a point TDC=0.

Accordingly, the peak value of the current waveform at the point corresponding to TDC=0 is calculated by only using a current applied to the linear motor compressor 24, in order to make the linear motor compressor operate at the duty-ratio corresponding to the peak value of the current waveform, the on/off cycle of the triac Tr1 is controlled by the switching control signal corresponding to the duty-ratio, and the operation of the linear motor compressor 24 is controlled so as to have the optimum efficiency.

In the meantime, as the working load on the linear motor compressor 24 varies according to changes in the operating circumstances, in order to operate the refrigerator efficiently, a limitation value is set on the basis of the initial current peak value as TDC=0, and the operation of the linear motor compressor 24 is controlled by the switching control signal corresponding to the initial current peak value, and at the same time, when the current applied to the linear motor compressor 24 is larger or smaller than the limitation value, a new current peak value at the optimum operation condition as TDC=0 is redetected, and the operation of the linear motor compressor 24 is thereafter controlled by the switching control signal generated according to the duty-ratio corresponding to the redetected current peak value. A method for controlling the operation of the linear motor compressor 24 in accordance with a first embodiment of the present invention will be described in detail with reference to accompanying FIG. 4.

Figure 4A:
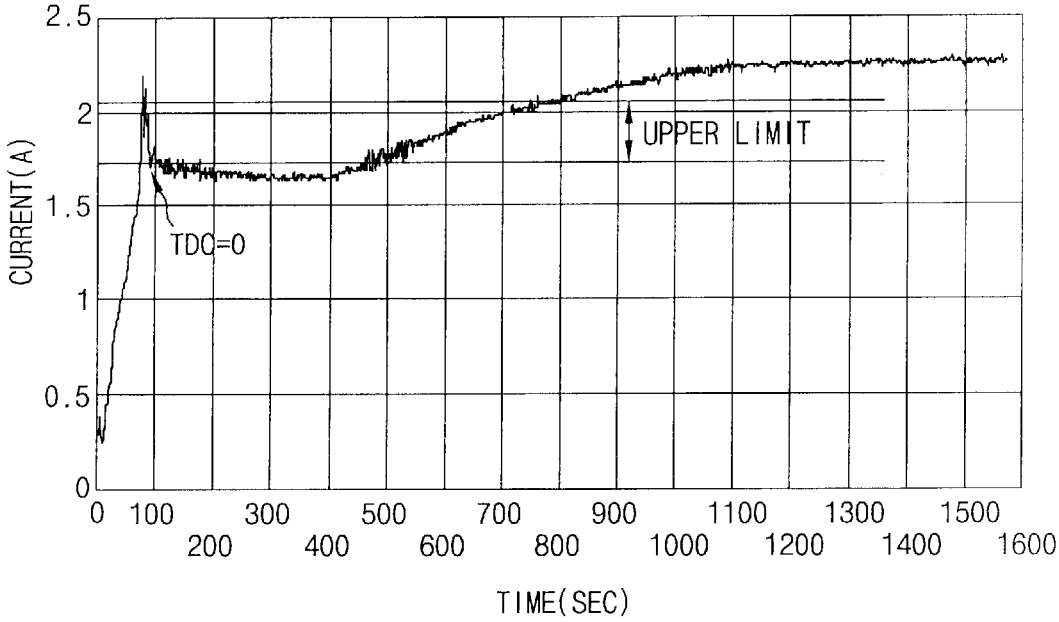
FIGS. 4A and 4B are waveform diagrams illustrating the variation in a current value according to the load variation of a refrigerator.
Figure 4B:
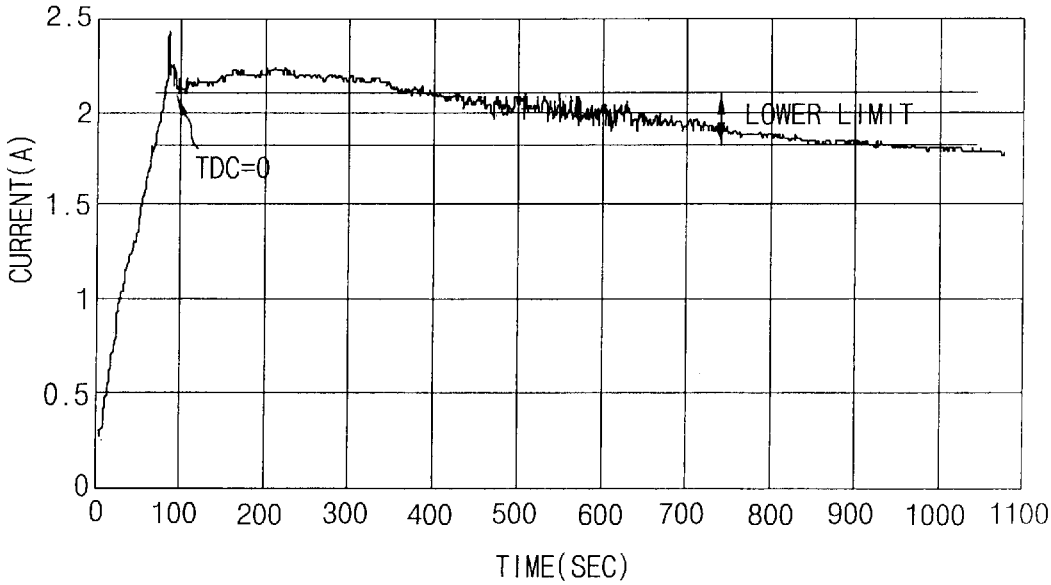

FIGS. 4A and 4B are waveform diagrams illustrating the variation in a current value according to the load variation of a refrigerator.

First, an initial current peak value of TDC=0 as an optimum operation condition is detected, and the operation of the linear motor compressor is controlled with a switching control signal at the detected initial current peak value. Herein, upper/low limitation value is set at a point detecting the initial current peak value.

Afterwards, the linear motor compressor 24 is operated by controlling the on/off operation (duty-cycle) of the triac Tr1 with the switching control signal at the initial current peak value of TDC=0 as the optimum operation condition of the linear motor compressor 24. Herein, while operating the linear motor compressor 24 by the switching control signal corresponding to the initial current peak value, the load may be varied according to changes in the refrigerator and the operation circumstances, as depicted in FIGS. 4A and 4B.

Accordingly, by comparing the current value applied to the linear motor compressor 24 with the lower limitation value set at the point of detecting the initial current peak value, when the current value applied to the linear motor compressor 24 is smaller than the set lower limitation value, a current peak value of TDC=0 is redetected, and the linear motor compressor 24 is operated thereafter by the switching control signal at the redetected current peak value.

On the contrary, by comparing the current value applied to the linear motor compressor 24 with the set upper limitation value, when the current value applied to the linear motor compressor 24 is larger than the set upper limitation value, a current peak value of TDC=0 is redetected, and the linear motor compressor 24 is operated by a switching control signal at the redetected current peak value.

In more detail, in the method for controlling the operation of the linear motor compressor 24 in accordance with the first embodiment of the present invention, while operating the linear motor compressor 24 by the switching control signal corresponding to the initial current peak value of TDC=0 as the optimum operation condition, when, due to changes in the refrigerator or the circumstances when a current applied to the linear motor compressor 24 at present is larger (than the upper limitation value) or smaller (than the lower limitation value) than the upper/lower limitation values set at the point at which the initial current peak value was detected, then a current peak value at TDC=0 as the optimum operation condition is redetected, and the operation of the linear motor compressor 24 is thereafter controlled by a switching control signal generated with a duty-ratio corresponding to the redetected current peak value.

Hereinafter, a method for controlling the operation of the linear motor compressor 24 in accordance with a second embodiment of the present invention will be described.

As depicted in FIGS. 4A and 4B, as the load on the linear motor compressor 24 varies according to changes in the refrigerator or the circumstances, then in order to operate the refrigerator efficiently, an initial current peak value at TDC=0 is detected and a certain time required for redetecting a current peak value at TDC=0 is set on the basis of the initial current peak value detecting time, and after the set certain time has passed while operating the linear motor compressor 24 with a duty-ratio corresponding to the initial current peak value, a new current peak value at TDC=0 as the optimum operation condition is redetected, and the operation of the linear motor compressor 24 can thereafter be controlled by a switching control signal generated according to the duty-ratio corresponding to the redetected current peak value. The method for controlling the operation of the linear motor compressor 24 in accordance with the second embodiment of the present invention will be described in more detail.

First, the initial peak value at TDC=0 as the optimum operation condition is detected, and a time for redetecting a current peak value at TDC=0 is set on the basis of the initial current peak value.

Afterwards, the linear motor compressor 24 is operated by controlling the on/off duty cycle of the triac Tr1 by the switching control signal corresponding to the initially set current peak value.

While controlling the operation of the linear motor compressor 24, when the operation time of the linear motor compressor 24 has not passed the set certain time, the operation of the linear motor compressor 24 is controlled continuously by the switching control signal corresponding to the initially set current peak value.

On the contrary, when the preset time has passed, the current peak value at TDC=0 is redetected, and the operation of the linear motor compressor 24 is thereafter controlled by the switching control signal corresponding to the redetected current peak value. Herein, when the current peak value at TDC=0 is detected, a timer (not shown) counts a time period from the initial detecting time of the current peak value to the redetecting time. The timer is included inside the microcomputer 25 or the timing operation may be performed by a software loop, etc.

Accordingly, in the method for controlling the operation of the linear motor compressor 24 in accordance with the second embodiment of the present invention, when the preset time has passed while operating the linear motor compressor 24 by the switching control signal corresponding to the point at TDC=0 initially set as the optimum operation condition, the linear motor compressor 24 is operated in the optimum state by redetecting a current peak value at TDC=0 and thereafter operating the linear motor compressor 24 by the switching control signal corresponding to the redetected current peak value.

Hereinafter, a method for controlling the operation of the linear motor compressor 24 in accordance with a third embodiment of the present invention will be described.

First, as depicted in FIGS. 4A and 4B, as the load on the linear motor compressor 24 varies according to changes in the refrigerator and the operating circumstances, in order to operate the refrigerator efficiently, an initial current peak value at TDC=0 is detected, and a maximum power quantity and a minimum power quantity are set on the basis of a power quantity calculated with a current value at a point corresponding to the minimum current peak value and a voltage generated across both ends of the coil winding of the motor of the linear motor compressor 24, the operation of the linear motor compressor 24 is controlled by a switching control signal corresponding to the initial current peak value, and while operating the linear motor compressor 24, when a quantity of power consumption applied to the motor (not shown) of the linear motor compressor is smaller than the set minimum power quantity or larger than the maximum power quantity, the current peak value at TDC=0 is detected, and the operation of the linear motor compressor 24 is thereafter controlled by controlling the on/off duty cycle of the triac Tr1 by a switching control signal corresponding to the detected current peak value. The method for controlling the operation of the linear motor compressor 24 in accordance with the third embodiment of the present invention will now be described in detail.

First, the initial current peak value at TDC=0 is detected and set as the optimum operation condition, and the maximum power quantity and the minimum power quantity consumed in the motor are set on the basis of a power quantity calculated with a current value at a point at which the initial current peak value is detected and a voltage is generated across both ends of the motor stator coil (not shown) of the linear motor compressor 24. Herein, instead of setting the maximum power quantity and the minimum power quantity, the maximum current value for redetecting TDC=0 as the optimum operation condition can be set on the basis of the currently detected and set peak value.

Afterwards, the linear motor compressor 24 is operated by controlling the on/off duty cycle of the triac Tr1 by the switching control signal corresponding to the initially set current peak value. Herein, when the linear motor compressor 24 is operated continuously by the switching control signal corresponding to the initial current peak value, the load may vary according to changes in the refrigerator and the operating circumstances, as depicted in FIGS. 4A and 4B. Herein, the power quantity consumed in the motor of the linear motor compressor 24 is compared with the set maximum power quantity and the minimum power quantity, and when the power quantity consumed in the motor is larger than the maximum power quantity or smaller than the minimum power quantity, the current peak value at TDC=0 is redetected, and the linear motor compressor 24 is thereafter controlled so as to operate always at the point of TDC=0.

In the meantime, when the power quantity consumed in the motor is between the set minimum power quantity and maximum power quantity, the linear motor compressor 24 is operated by controlling the on/off duty cycle of the triac Tr1 by the switching control signal applied to the triac Tr1.

Accordingly, in the method for controlling the operation of the linear motor compressor 24 in accordance with the third embodiment of the present invention, while operating the linear motor compressor 24 by the switching control signal corresponding to the initial current peak value at TDC=0 as the optimum operation condition, when the power quantity consumed in the motor is larger than the set maximum power quantity or smaller than the set minimum power quantity due to the changes in the refrigerator or the operating circumstances, the linear motor compressor 24 (refrigerator) can operate at the optimum condition by always controlling the on/off operation of the triac Tr1 by the switching control signal corresponding to the current peak value at TDC=0.

Hereinafter, a method for controlling the operation of the linear motor compressor 24 in accordance with a fourth embodiment of the present invention will be described in detail with reference to accompanying FIG. 5.

Figure 5:
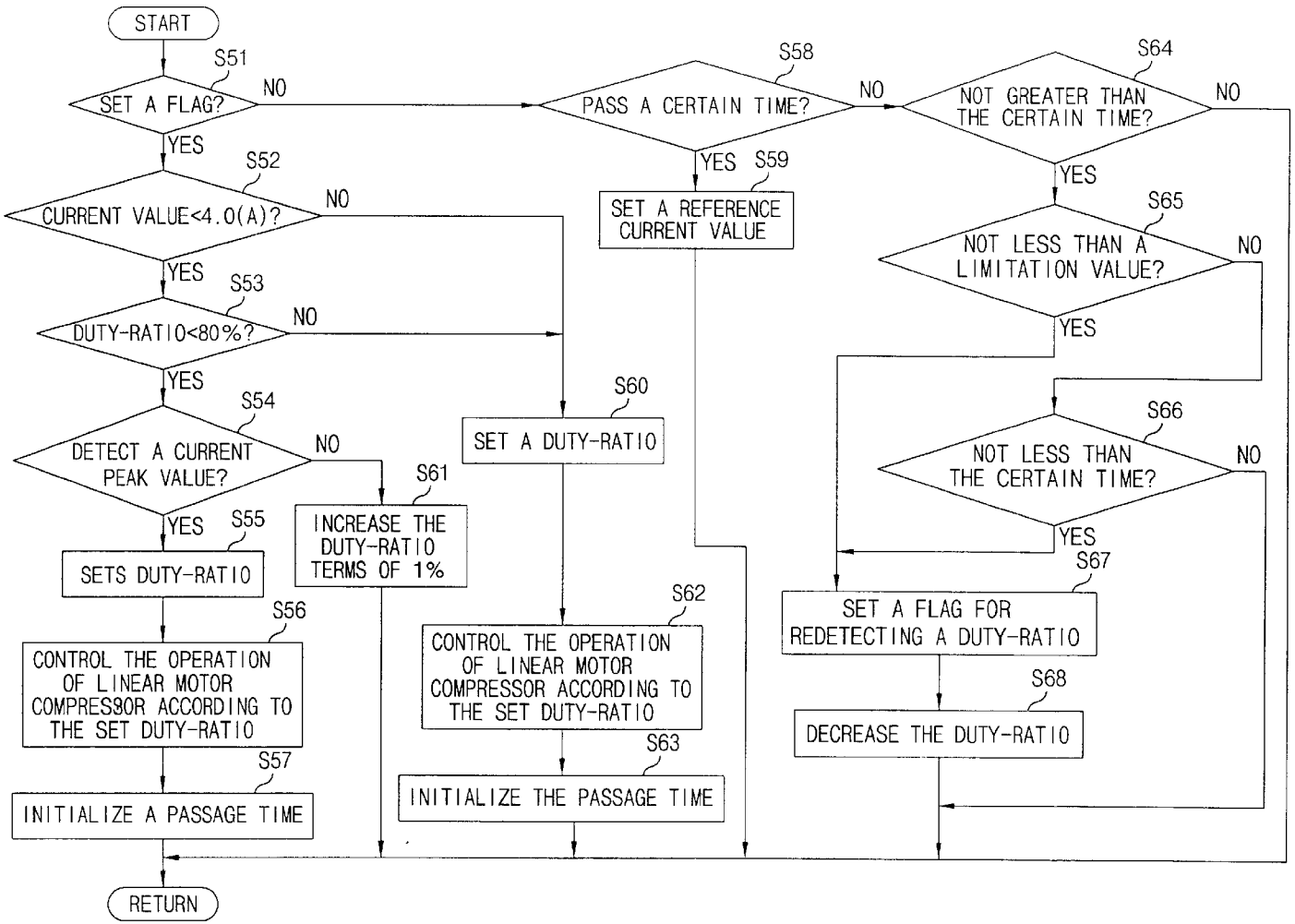
FIG. 5 is a flow chart illustrating a method for controlling the operation of a linear motor compressor of a refrigerator in accordance with the present invention.

FIG. 5 is a flow chart illustrating a method for controlling the operation of a refrigerator in accordance with the present invention.

First, the microcomputer 25 operates the linear motor compressor 24 at the optimum state and at the same time judges whether a flag for detecting the duty-ratio according to the load variation on the linear motor compressor 24 is set as shown at step S51.

When the flag is judged as set, the microcomputer 25 then judges whether the current value detected from the current detecting unit 22 is less than a certain value, for example, 4.0 amperes as shown at step S52. When the current value detected from the current detecting unit 22 is judged as not greater than the certain value (4A), it is judged whether a duty-ratio corresponding to the detected current value is less than a certain percentage, for example, 80%, as shown at step S53. Herein, when the duty-ratio of the switching control signal is judged as less than the certain percentage (80%) and the detected current value is judged as less than the certain value (4A), the microcomputer 25 detects the current (current waveform) generated in the motor of the linear motor compressor 24, as shown at step S54.

When the peak value of the current (current waveform) is not detected, the microcomputer 25 increases the duty-ratio in terms of a certain percentage amount, as shown at step S61. Herein, for example, the certain percentage as 1%.

On the contrary, when the peak value of the current (current waveform) at which the duty-ratio is less than a certain percentage (80%) and the detected current value is less than a certain value (4A) is detected, the microcomputer 25 sets the duty-ratio corresponding to the detected current waveform as a present duty-ratio as shown at step S55 and controls the operation of the linear motor compressor with the switching control signal according to the set duty-ratio as shown at step S56. Herein, the passage time after detecting the duty-ratio is initialized as 0, as shown at step S57.

In the meantime, when the duty-ratio is not less than the certain percentage (80%) and the detected current value is not less than the certain value (4A), a duty-ratio (not less than 80%) at the operating point is set, as shown at step S60, and the operation of the linear motor compressor is controlled by the switching control signal according to the thusly set duty-ratio, as shown at step S62. Herein, the passage time after detecting the duty-ratio is initialized as 0, as shown at step S63.

In the meantime, in the judging process for judging whether the flag for detecting the duty-ratio is set as shown at step S51, it is judged whether a certain time has passed after detecting the duty-ratio as shown at step S58. Herein, the certain time may for example be set as 60 seconds. Herein, a reference current value for detecting the load variation is set at a point at which the time after detecting the duty-ratio has passed the certain time (60 sec), as shown at step S59. Herein, the reference current value is set between the point of detecting the duty-ratio and the certain time (60 sec).

On the contrary, when the time after detecting the duty-ratio has not passed the certain time (60 sec), it is judged whether the time after detecting the duty-ratio is less than the certain time (60 seconds) as shown at S64.

On the contrary, when the time after detecting the duty-ratio has not passed the certain time (60 sec), as depicted in FIGS. 4A and 4B, the load variation is detected by using the upper/lower limitation values. In more detail, the difference in the current is calculated at a point at which the time after detecting the set reference current value and the duty-ratio is not greater than the certain time (60 sec), and it is judged whether the calculated value is not less than the limitation value (that is, it is judged whether any load variation occurs), as shown at step S65. Herein, the limitation value may for example be set as 0.3 A.

When the calculated value is not less than the set limitation value (0.3 A) (that is, when a load variation is detected), a flag for redetecting the duty-ratio is set, as shown at step S67, and the detected duty-ratio is decreased in terms of a certain value (for example, 20%), as shown at step S68.

On the contrary, when the calculated value is not greater than the limitation value (0.3 A) (that is, when a load variation is not detected) and the time passage after detecting the duty-ratio is not less than a certain time (for example, 1200 sec) as shown at step S66, a flag for redetecting the duty-ratio is set as shown at step S67, and the detected duty-ratio is decreased in terms of a certain value (for example, 20%).

Accordingly, in the method for controlling the operation of the linear motor compressor in accordance with the fourth embodiment of the present invention, the current applied to the motor (linear motor compressor) is detected, the load variation is detected according to the detected current variation, and therefore the operation of the linear motor compressor is controlled by the switching control signal generated according to the duty-ratio corresponding to the peak value of the detected current.

As described above, in the apparatus and method for controlling the operation of the linear motor compressor in accordance with the present invention, by generating a switching control signal according to a duty-ratio corresponding to a peak value of a current waveform by a linear method considering a mechanical motion characteristic (severe non-linearity) of the linear motor compressor, the operation of the linear motor compressor can be controlled precisely and accurately.

In addition, the operation cost can be reduced by controlling the operation of the linear motor compressor with a precise current applied to the linear motor compressor.

In addition, while operating the linear motor compressor 24 by the switching control signal of the initial current peak value at TDC=0 as the optimum operation condition, when due to changes in the refrigerator and the operating circumstances the current applied to the linear motor compressor at present is larger than the formerly set current maximum value, by varying a duty-ratio corresponding to the initial detected current value, the operation of the refrigerator can be controlled at the optimum condition as TDC=0.

In addition, in order to sense the non-linearity of the linear motor compressor due to the mechanical characteristics of the linear motor compressor, while operating the linear motor compressor by the switching control signal generated according to a duty-ratio corresponding to a point of TDC=0, after a certain time passage, by redetecting the point of TDC=0 and operating the linear motor compressor by a switching control signal generated according to the duty-ratio corresponding to the point of TDC=0, the refrigerator (linear motor compressor) can be operated with the optimum efficiency.

In addition, in order to sense the non-linearity of the linear motor compressor due to the mechanical characteristics of the linear motor compressor, while operating the linear motor compressor by a switching control signal corresponding to an initial current peak value at TDC=0, when the quantity of power consumption of a motor 9 linear motor compressor) is greater than a preset maximum power quantity or less than a preset minimum power quantity, by redetecting a current peak value at TDC=0 and controlling the on/off operation of a triac by a switching control signal according to the current peak value at TDC=0, accordingly the linear motor compressor can be always operated in the optimum state.

In addition, by judging a current applied to the motor of the linear motor compressor and judging the load variation from the detected current, the operation of the linear motor compressor can be controlled at a point of TDC=0 as the optimum state.

What is claimed is:

1. An apparatus for controlling operation of a linear motor compressor, comprising:

a current detecting unit for detecting a current applied to a linear motor compressor;

a current peak value detecting unit for detecting a current peak value by comparing the detected current with a formerly detected current;

a microcomputer for recognizing the current peak value as a point of TDC (Top Dead Center)=0 and outputting a switching control signal according to a duty-ratio corresponding to the point of TDC=0; and a power supply unit for operating the linear motor compressor by controlling operation of an internal triac according to the switching control signal.

2. The apparatus of claim 1, wherein the current peak value detecting unit detects a current peak value when the formerly detected current is larger than the presently detected current.

3. A method for controlling operation of a linear motor compressor, comprising:

detecting an initial current peak value as TDC (Top Dead Center)=0 on the basis of a current supplied to a linear motor compressor, setting a limitation value at a point of detecting the initial current peak value; and redetecting a current peak value as TDC=0 by comparing the limitation value with a current value generated in the linear motor compressor according to variation of a load on the linear motor compressor.

4. The method of claim 3, wherein the current peak value is redetected when a current value generated in the linear motor compressor is larger or smaller than the limitation value.

5. The method of claim 3, wherein the linear motor compressor operates at a duty-ratio corresponding to the detected current peak value.

6. The method of claim 3, wherein the linear motor compressor operates at a duty-ratio corresponding to the initial current peak value when the detected current value exists within the limitation value.

7. A method for controlling operation of a linear motor compressor, comprising:

detecting an initial current peak value as TDC=0 by comparing a current applied to a linear motor compressor with a formerly detected current;

setting a certain time period for redetecting an optimum operation condition as TDC=0 on the basis of a time of detecting the initial current peak value;

judging whether the certain time period is passed while operating the linear motor compressor with a switching control signal corresponding to the initial current peak value; and redetecting a current peak value as TDC=0 after the certain time period is passed and operating the linear motor compressor with a switching control signal corresponding to the redetected current peak value.

8. The method of claim 7, wherein the operation of the linear motor compressor is controlled by a switching control signal corresponding to the initial current peak value when the certain time period is not passed on the basis of the initial current peak value detecting time.

9. A method for controlling operation of a linear motor compressor, comprising:

detecting a current peak value as TDC=0 by comparing a current applied to a linear motor compressor with a formerly detected current;

setting a maximum current value for redetecting an optimum operation condition at TDC=0 on the basis of the detected current peak value;

operating the linear motor compressor with a switching control signal corresponding to the detected current peak value and at the same time comparing a first current value applied to the linear motor compressor with the set maximum current value; and detecting a current peak value at TDC=0 when the first current value is larger than the set maximum current value.

10. The method of claim 9, wherein the operation of the linear motor compressor is controlled by the switching control signal corresponding to the current peak value when the first current value is smaller than the set maximum current value.

11. A method for controlling operation of a linear motor compressor, comprising:

detecting an initial current peak value at TDC=0;

detecting a quantity of power consumption on the basis of a current and a voltage generated in the linear motor compressor;

setting a minimum power quantity and a maximum power quantity on the basis of the detected current and voltage; and operating the linear motor compressor by a switching control signal corresponding to the initial current peak value, while at the same time comparing the quantity of power consumption with the maximum power quantity and the minimum power quantity and controlling the operation of the linear motor compressor according to the comparison result.

12. The method of claim 11, wherein a current peak value at TDC=0 is redetected and the operation of the linear motor compressor is controlled by a switching control signal corresponding to the redetected current peak value when the quantity of power consumption is larger than the set maximum power quantity or smaller than the minimum power quantity.

13. The method of claim 11, wherein the linear motor compressor operates by a switching control signal corresponding to the initial current peak value when the quantity of power consumption exists between the minimum power quantity and the maximum power quantity.

14. A method for controlling operation of a linear motor compressor, comprising:

detecting an initial current peak value as TDC=0 by comparing a current applied to a linear motor compressor with a formerly detected current;

setting a redetecting time period for detecting a current peak value as TDC=0 on the basis of a detecting time point of the initial current peak value;

judging whether the set redetecting time period is passed and at the same time operating the linear motor compressor with a switching control signal corresponding to the initial current peak value; and redetecting a current peak value as TDC=0 and controlling the operation of the linear motor compressor with a switching control signal corresponding to the detected current peak value.

15. The method of claim 14, wherein the redetecting time period is counted from the detecting point at which the current peak value at TDC=0 is detected.

16. A method for controlling operation of a linear motor compressor, comprising:

judging whether a flag for detecting a duty-ratio of a driving current of a linear motor compressor is set;

judging whether a peak value of a current waveform driving the linear motor compressor and a duty-ratio corresponding to the current peak value is not greater than a certain value;

detecting a peak value of the driving current and generating a switching control signal according to a duty-ratio corresponding to the detected peak value when the current value and the duty-ratio are not greater than the certain value; and operating the linear motor compressor according to the switching control signal.

17. The method of claim 16, further comprising:

decreasing the duty-ratio by of a certain value when the peak value of the current is not detected.

18. The method of claim 16, wherein the certain value of the current peak value is 4A.

19. The method of claim 16, wherein the certain value of the duty-ratio is 80%.

20. The method of claim 16, further comprising:

operating the linear motor compressor by a switching control signal corresponding to the duty-ratio when the peak value of the current and the duty-ratio corresponding to the peak value of the current are not less than the certain value.

21. The method of claim 16, further comprising:

judging whether a certain time is passed after detecting the duty-ratio when the flag is not set; and decreasing the duty-ratio on the basis of a preset limitation value when the certain time is not passed.

22. The method of claim 21, wherein the difference of the current at a point at which the time after detecting the preset reference current and the duty-ratio is not greater than the certain time is calculated, and the duty-ratio is decreased when the calculated value is not less than the limitation value in the duty-ratio decreasing process.

23. The method of claim 22, wherein the duty-ratio is decreased when the calculated value is not greater than the limitation value and the time after detecting the duty-ratio is not less than the certain time.

* * * * *